United States Patent [19]

Den Ouden

[11] 3,965,610

[45] June 29, 1976

[54] CONSTRUCTION UNITS, SOME WITH CORRESPONDING PINION WHEELS MOUNTED IN MESHED RELATION

[75] Inventor: Alfons Adriaan Den Ouden, Antwerp, Belgium

[73] Assignee: Brabo Corporation Naamloze Vennootschap, Antwerp, Belgium

[22] Filed: Aug. 5, 1974

[21] Appl. No.: 494,867

[30] Foreign Application Priority Data

Sept. 7, 1973 United Kingdom ..... 42209/73

[52] U.S. Cl. ..... 46/17; 35/13; 46/30; 46/25

[51] Int. Cl.[2] ..... A63H 33/04

[58] Field of Search ..... 46/17, 30, 25, 31, 23, 46/26; 35/13

[56] References Cited

UNITED STATES PATENTS

| | | | |
|---|---|---|---|
| 2,692,443 | 10/1954 | Milligan | 35/13 X |
| 2,871,619 | 2/1959 | Walters | 46/30 X |
| 2,994,154 | 8/1961 | McCaa | 35/13 X |
| 3,193,293 | 7/1965 | Schaper | 35/13 X |
| 3,212,200 | 10/1965 | Lundberg | 35/13 |
| 3,461,600 | 8/1969 | Kristiansen | 46/23 X |
| 3,484,983 | 12/1969 | Fischer | 46/23 X |
| 3,513,587 | 5/1970 | Fischer | 46/23 |
| 3,623,261 | 11/1971 | Freese | 46/30 |
| 3,852,909 | 12/1974 | Viebcke | 46/25 X |

FOREIGN PATENTS OR APPLICATIONS

| | | | |
|---|---|---|---|
| 22,072 | 2/1902 | United Kingdom | 46/17 |

*Primary Examiner*—F. Barry Shay
*Attorney, Agent, or Firm*—Baldwin, Wight & Brown

[57] ABSTRACT

A toy comprising a base and means on the base rotatably mounting a plurality of pinion wheels in interengaging relationship one with another so that different patterns of the pinion wheels may be created.

9 Claims, 10 Drawing Figures

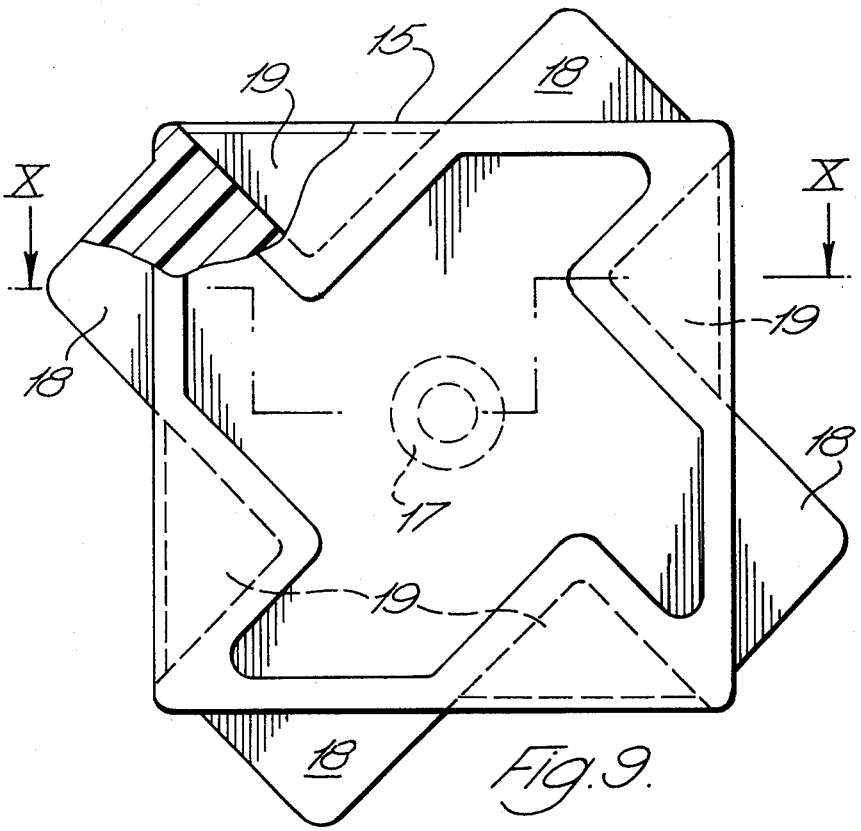
Fig. 9.
Fig. 10.
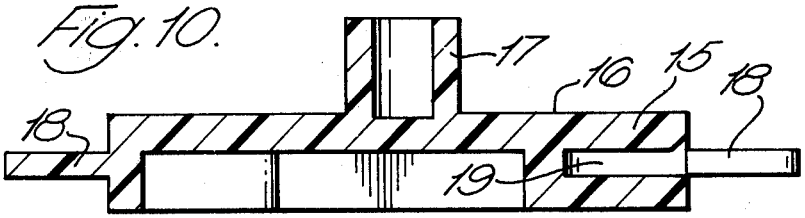

CONSTRUCTION UNITS, SOME WITH CORRESPONDING PINION WHEELS MOUNTED IN MESHED RELATION

This invention relates to a toy, and in particular to a toy which allows children to exercise their creative ability.

According to the invention, a creative toy comprises a base and means on the base rotatably mounting a plurality of pinion wheels in interengaging relationship one with another so that different patterns of the pinion wheels may be created.

Preferably, the base comprises a plurality of interlocking units on each of which a pinion wheel is rotatably mounted, the pinion wheel being of such a size that when two units are interlocked pinion wheels on the two units interengage.

Preferably also a number of interlocking units having no pinion wheel thereon are provided so that the pattern may be more clearly seen against the base.

In one embodiment, the interlocking units comprise substantially planar and square panels having along two edges thereof a projecting rib and along the other two edges a groove, ribs and grooves of adjacent panels interlocking to form a planar base.

In a preferred embodiment, the interlocking units comprise substantially planar and square panels having along each edge thereof a projecting triangular tongue adjacent to a triangular groove, tongues and grooves of adjacent panels interlocking with a forced fit to form a planar base.

The pinion wheels may be variously coloured in order to make the pattern stand out and to provide more interest for a child playing with the toy.

Figure 1:
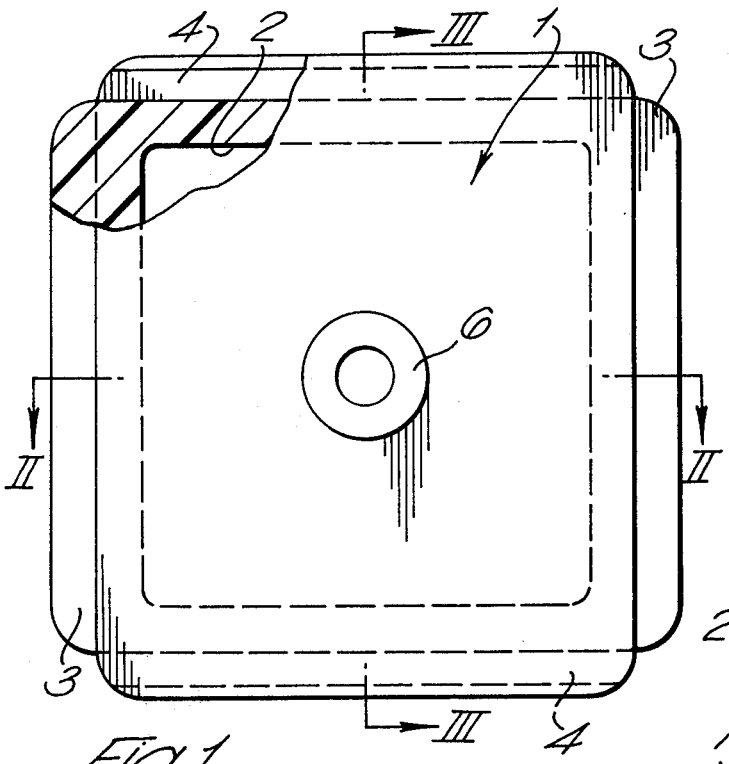
Figure 3:
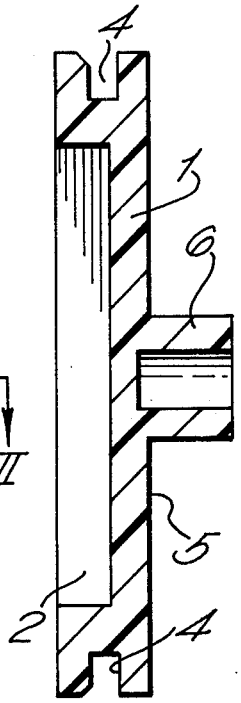
Figure 2:
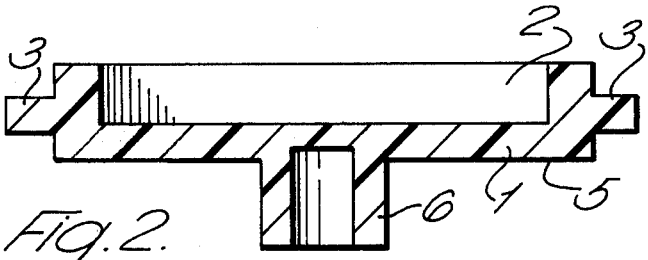
Figure 4:
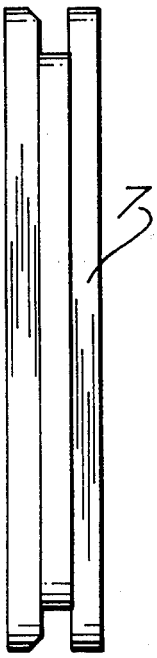
Figure 5:
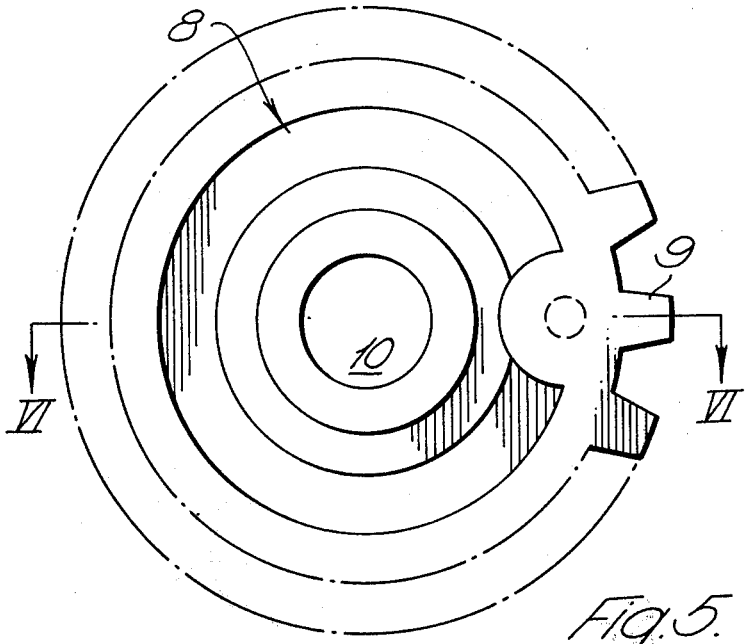
Figure 6:
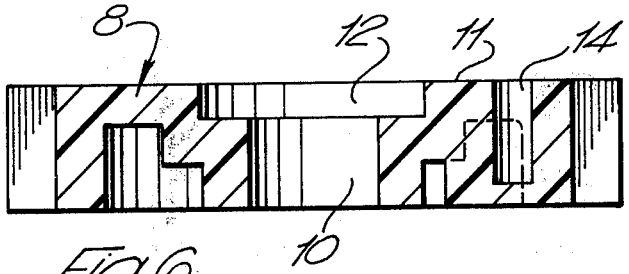
Figure 7:
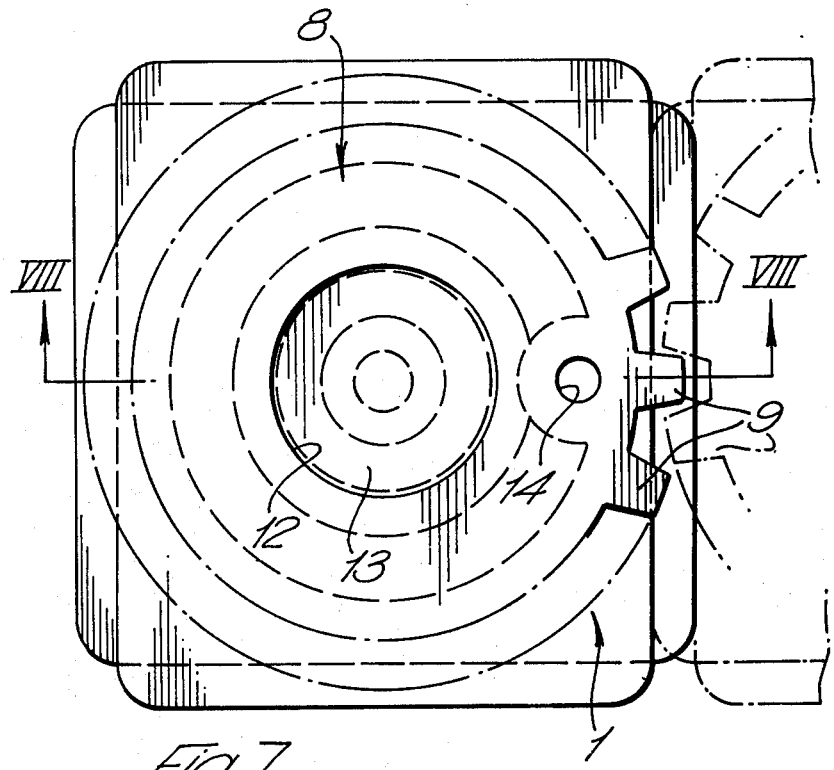
Figure 8:
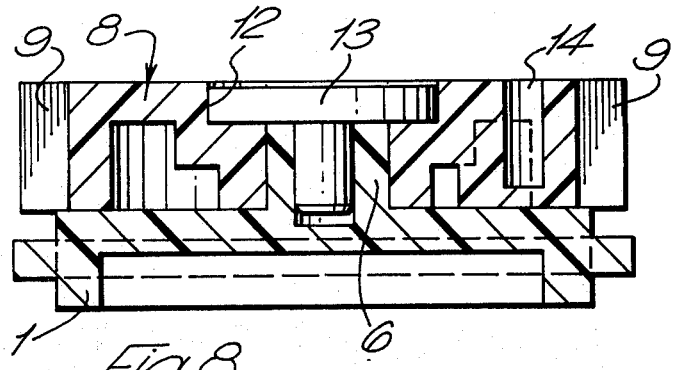

The invention is now described with reference to the accompanying drawings, in which FIG. 1 is a plan part-sectional view of a base unit for receiving a pinion wheel, FIG. 2 is a cross-section along line II—II of FIG. 1, FIG. 3 is a cross-section along line III—III of FIG. 1, FIG. 4 is a side elevation of a base unit similar to that of FIG. 1 but not adapted to receive a pinion wheel, FIG. 5 is an underside view of a pinion wheel, FIG. 6 is a cross-section along line VI—VI of FIG. 5, FIG. 7 is a plan view of a base unit carrying a pinion wheel, FIG. 8 is a cross-section along the line VIII—VIII of FIG. 7, FIG. 9 is an underside part-sectional view of an other embodiment of base unit, and FIG. 10 is a section along the line X—X of FIG. 9.

Referring to FIGS. 1–3 a base unit for receiving a pinion wheel comprises a substantially square panel 1 with a recessed base 2. Along two opposed edges of the panel are ribs 3 and along the other opposed edges are grooves 4. The ribs and grooves of adjacent panels interlock so that their top surfaces 5 are coplanar. Projecting upwardly from the centre of the top surface 5 is a hollow cylindrical stub 6 which provides an axle for a pinion wheel.

Referring now to FIG. 4, a base unit not adapted to receive a pinion wheel comprises a panel 7 which is identical to the panel 1 except that it does not include the stub 6, having a completely flat top surface instead.

Referring to FIGS. 5 and 6, a pinion wheel 8 has peripheral teeth 9, only three of which are shown and a central aperture 10 which is of a size to receive the stub axle 6 of a base unit.

The top surface 11 of the pinion wheel is provided with a circular recess 12 concentric with the aperture 10.

Referring now to FIGS. 7 and 8, there is shown a pinion wheel 8 in position on a panel 1. It can be seen that the pinion wheel is received on the stub axle 6 and can rotate on the axle.

The pinion wheel is secured in position by means of a pin 13 which is a push-fit in the hallow stub axle 6 and the head of which is received in the circular recess 12.

A small hole 14 is formed in the top surface of the pinion wheel 8 and, if desired, a pointed article such as a pencil may be inserted in this hole and used to turn the wheel.

Referring to FIGS. 9 and 10, there is shown an alternative embodiment of base unit. The base unit 15 is square and has a planar upper surface 16 from which projects an upstanding hollow stub 17 adapted to receive the pinion wheel 8.

Projecting from each edge of the base unit 15 is a triangular tongue 18 extending over half the length of the edge. Extending over the other half of the edge is a triangular slot 19 of a dimension to receive a tongue 18 of an adjacent base unit.

The base unit 15 can therefore fit together to form a planar base for mounting a plurality of pinion wheels. As with the other embodiment of base unit, certain of the units 15 may not be provided with the stub 17.

The entire construction is preferably made of plastics material, although any suitable material may be used.

In use, the child playing with the toys arranges those base units carrying the pinion wheels in a contiguous array to make up the desired pattern and may then use the plain base units to fill up the gaps in the pattern. Then when one pinion wheel is rotated, all the other wheels of the contiguous array may be seen to rotate.

In an alternative embodiment, the base may comprise a single planar panel provided at regular intervals with upwardly-projecting axles to receive pinion wheels. In this case, the pinion wheels are simply arranged on the board as desired and may, if wished, be secured in place by a pin such as the pin 13 of the preferred embodiment.

It will be appreciated that there are ways of rotatably mounting the pinion wheels on the base unit other than that particularly described herein.

What is claimed is:

1. A toy kit for exercising the creative ability of children comprising a plurality of individual units, each of said units having upper and lower faces and carrying cooperative integral means laterally of said faces for directly interlockingly uniting the same together with said upper faces in side by side relation in a desired pattern so as to create a flat generally horizontally disposed base, a plurality of pinion wheels, at least two of said pinion wheels and two of said upper faces of said individual units having mutually cooperable means for rotatably mounting a maximum of one said pinion wheel per individual unit, and said at least two pinion wheels and said two individual units being so constructed, arranged and dimensioned that said at least two pinion wheels are in meashed relationship when said at least two individual units are united by said integral uniting means.

2. The toy kit as defined in claim 1 wherein at least said upper face is planar.

3. The toy kit as defined in claim 1 wherein said lower face is planar.

4. The toy kit as defined in claim 1 wherein said upper and lower faces are planar.

5. The toy kit as defined in claim 16 wherein said means for rotatably mounting said pinion wheels relative to said individual units, are cooperative apertures and shafts.

6. The toy kit as defined in claim 5 wherein at least some of said individual units are devoid of said mounting means whereby a pinion wheel could not be mounted for relative rotation thereupon.

7. The toy kit as defined in claim 1, wherein said cooperative integral means includes grooves and projecting ribs, and the grooves and ribs of one unit interlocking with the ribs and grooves of an immediately adjacent unit to form said base.

8. The toy kit as defined in claim 1, wherein said cooperative integral means includes grooves and projecting ribs, the grooves and ribs of one unit interlocking with the ribs and grooves of an immediately adjacent unit to form said base, said grooves of each individual unit being arranged in pairs, and said ribs of each individual unit being arranged in pairs.

9. The toy kit as defined in claim 1, wherein said cooperative integral means includes grooves and projecting ribs, the grooves and ribs of one unit interlocking with the ribs and grooves of an immediately adjacent unit to form said base, said grooves of each individual unit are in parallel relationship to each other, and said ribs of each individual unit are in parallel relationship to each other.

* * * * *